United States Patent [19]

Breen

[11] Patent Number: 4,611,826

[45] Date of Patent: Sep. 16, 1986

[54] ANTI-FRAUD CREDIT CARD TRANSACTION FORMSET

[75] Inventor: Thomas J. Breen, Arlington Heights, Ill.

[73] Assignee: Rand McNally & Co., Skokie, Ill.

[21] Appl. No.: 700,139

[22] Filed: Feb. 11, 1985

Related U.S. Application Data

[63] Continuation-in-part of Ser. No. 425,064, Sep. 30, 1982, Pat. No. 4,512,595.

[51] Int. Cl.[4] ..... B41L 1/20; B41L 1/24

[52] U.S. Cl. ..... 282/8 R; 282/9 R; 282/11.5 A; 282/22 R; 283/58

[58] Field of Search ..... 282/1 R, 2, 8 R, 9 R, 282/11.5 A, 11.5 R, 22 R; 427/153; 283/58

[56] References Cited

U.S. PATENT DOCUMENTS

| | | | |
|---|---|---|---|
| 3,113,516 | 12/1963 | Johnson | 283/58 |
| 3,226,134 | 12/1965 | Breidthardt | 282/22 R |
| 3,233,918 | 2/1966 | Tathwell | 282/9 R |
| 3,981,523 | 9/1976 | Maalouf | 282/22 R |
| 4,045,053 | 8/1977 | Carriere | 282/22 R |
| 4,136,895 | 1/1979 | McKinzie et al. | 282/22 R |
| 4,208,066 | 6/1980 | Steidinger | 282/11.5 A |
| 4,238,549 | 12/1980 | Dapp et al. | 427/153 |
| 4,403,793 | 9/1983 | McCormick | 282/9 R |

*Primary Examiner*—Paul A. Bell
*Assistant Examiner*—Paul M. Heyrana, Sr.
*Attorney, Agent, or Firm*—Dressler, Goldsmith, Shore, Sutker & Milnamow, Ltd.

[57] ABSTRACT

A secure credit card formset which insures against customer credit identification falling into unauthorized with normally discarded formset portions is disclosed. The carbon paper slip is formed with a readily severable segment in the zone where the customer's credit card information is adapted to be imprinted. During manufacture, this segment is adhered to the bottom surface of the customer's transaction slip copy so that it is automatically handed in its entirety to the customer with his copy. No portion of the discarded formset stub and carbon paper slip contains the customer's credit card information.

16 Claims, 6 Drawing Figures

ANTI-FRAUD CREDIT CARD TRANSACTION FORMSET

RELATED APPLICATION

This application is a continuation-in-part of U.S. patent application Ser. No. 425,064 filed Sept. 30, 1982, now U.S. Pat. No. 4,512,595, issued Apr. 3, 1985.

TECHNICAL FIELD

This invention relates to credit card transaction slip packs known as formsets and more particularly to credit card formsets having means for preventing fraudulent use of the customer's credit card information imprinted on carbon slips during use and issuance.

BACKGROUND ART

The ever expanding use of credit card transactions has given rise to a proliferation of wrongful and fraudulent practices by unauthorized persons. Such fraudulent practices are made possible, in large measure, by the nature of the formsets employed and the manner in which the customer identification information, as well as the particulars of the transaction, are physically applied thereto.

Typically, the credit card transaction formsets consist of at least two superposed paper slips and a duplicating medium slip between an adjacent pair of slips for simultaneously imprinting the transaction information on all of the slips. The transaction information includes, of course, the customer's credit card identification and the details of the sale or purchase.

In their most commonly used form, the formsets furnished to the merchant or business establishment usually consist of a top or first transaction slip to be retained by the merchant, the merchant copy, a second slip to be given to the customer, the customer copy, and a third slip to be given to the bank or credit card issuer, the credit card issuer copy. Duplicating medium slips, typically "carbon paper" or the like, are usually interleaved between the first and second slips and between the second and third slips. The term "carbon paper" is used herein in its broadest sense to include pressure duplicating mediums of all types and pigmentations, such as the common black carbon sheets and the red coated surfaces of airplane tickets and the like.

A transaction is recorded by placing the customer's embossed credit card and a blank formset in a well-known image impressing machine. When the merchant slides the movable member of the machine thereover, the customer's credit information becomes visualized as a positive image on the top surfaces of the second and third slips and on the bottom surface of the first slip which is normally transparent or translucent. The carbon paper between the first and second slips is usually double-sided, thereby also to provide an image on the bottom surface of the first slip. The details of the transaction are then written on the top slip, as with a pencil or ball point pen, so that a positive image thereof is formed on all three transaction slips. After signature by the customer, the second or customer slip is removed from the formset and given to the customer, and the first and third record-keeping transaction slips are retained and forwarded as required. The carbon paper slips are usually simply discarded into a waste container for disposal.

Those skilled in the art will appreciate that during the described process of imprinting positive images on the transaction slips, identical but negative images of all of the information are formed on the carbon paper slips. It is now recognized that in the hands of unscrupulous persons, the discarded carbon paper slips provide the essential customer identification information used to make fraudulent and unauthorized purchases. Seemingly, a primary solution to the problem of fraudulent purchases is readily achievable, namely, insuring that the discarded image-bearing carbon paper slips do not fall into unauthorized hands. However, that solution has proved at best only partially successful.

One suggested solution has been to hand the entire carbon paper slips to the customer, together with his transaction slip copy. This is objectionable because it requires an explanation by the busy waiter or clerk and can result in staining of the customer's hands and clothing.

Another proposal has been the elimination of carbon paper slips and the use of transaction slips coated with known microencapsulated dyes and the like. However, the cost of carbonless formsets is substantially higher and that increased cost has not been found acceptable or justified for the many millions of credit card transactions effected daily.

Another proposal, as well as a description of the magnitude of the fraud problem, is offered in U.S. Pat. No. 4,403,793. According to that proposal, the two carbon paper slips are integrated into a subassembly with the customer's slip copy at the normally free edges of those slips. At a point closer to the inner edges of the carbon paper slips, those slips are formed with lines of perforations that intersect the area where the credit card information is impressed. When the customer's copy is removed from the formset, the carbon paper slips tear off at the perforations so that a portion of the customer identification information remains with the formset stub. Thereafter, the customer's slip copy is removed from the associated portions of the carbon paper slips and handed to the customer, and the carbon portions are discarded. That formset construction is not only relatively complex, but there still exists the possibility of unauthorized mating of the discarded carbon paper stubs and carbon paper slip portions to provide complete customer identification information.

Other aspects of the fraudulent use and/or improper alteration of multiple forms are discussed in my copending application, Ser. No. 425,064, filed Sept. 30, 1982, and entitled "Tamper-Resisting Negotiable Instruments Containing A Transparent Verifying Web." One element of the forms disclosed therein is a slip coated on both its top and bottom surfaces. The top surface visualizes a negative image and impresses a positive image on the bottom surface of a transparent or translucent slip above it. The bottom surface is coated, as with a red transferring medium, and produces a positive image on the slip beneath it. The product of that application eliminates the type of fraud problem which is possible with conventional credit card formsets. However, the increased cost of using such double coated slips may be objectionable, even though the system of that application does avoid the fraud problem discussed above.

Improved, secure, and satisfactory solutions to the fraud problem as described above are to be desired.

SUMMARY OF THE INVENTION

According to the present invention, a credit card formset is provided which virtually insures that normally discarded portions thereof bearing the customer's credit identification will not fall into unauthorized hands. Instead, a normally discarded portion of the carbon paper slip which invariably carries a negative image of the credit information is automatically given to the customer attached to his transaction copy.

In a preferred form, the formset comprises a first transaction slip intended for the merchant and the entry of the transaction details thereon, a second transaction slip to be given to the customer, and a third transaction slip as a record for the bank or credit card issuer. A carbon paper slip is positioned between the second and third transaction slips and has a removable or severable segment thereof secured to the bottom surface of the customer's transaction slip.

The first transaction slip is substantially transparent and the bottom surface thereof is coated with an image receiving waxy substance. The customer's slip is coated on its top surface with an image transferring layer. Any image inscribed or impressed on the formset appears as a negative image on the customer's slip and as a positive image on the bottom surface of the merchant's slip.

Preferably, the carbon paper segment is defined by a readily severable line of perforation or cut which opens to the upper edge of the carbon paper slip. During assembly, adhesive is applied between the bottom surface of the customer's slip and the top surface of the carbon paper segment so that removal of said segment with the customer's slip is assured.

BRIEF DESCRIPTION OF THE DRAWINGS

In the accompanying drawings forming a part of the specification, and in which like numerals are employed to designate like parts of the same.

DETAILED DESCRIPTION

Figure 1:
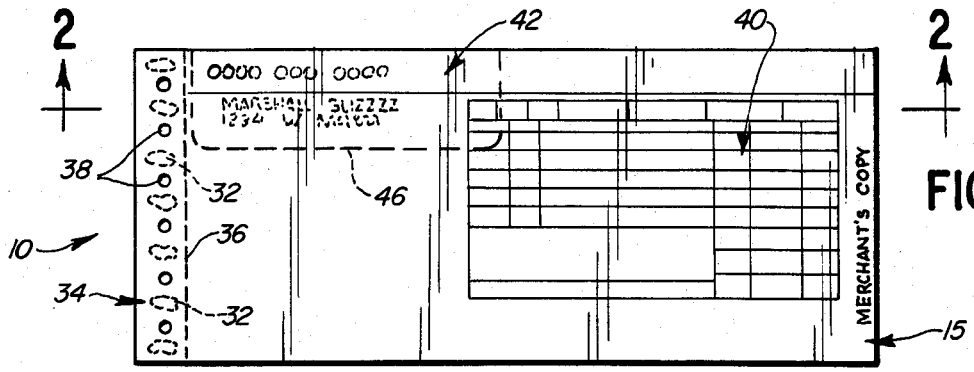
FIG. 1 is a top plan view of a credit card transaction formset embodying the principles of the present invention.
Figure 2:
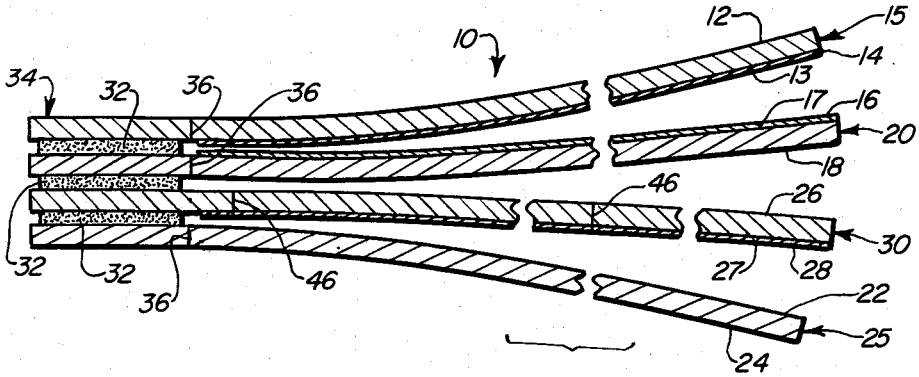
FIG. 2 is an enlarged schematic cross-sectional view taken along line 2—2 of FIG. 1 and shown, for ease of illustration, in partially open position.

Referring with greater particularity to the various figures of the drawings, it will be seen that the reference numeral 10 indicates generally a credit card transaction formset embodying the principles of the invention. For ease of description, the formset 10 is illustrated and will be described as comprising three transaction slips, although it should be understood that the principles of the invention may apply as well to formsets containing at least two or more than three transaction slips.

Formset 10 comprises a top, or first transaction slip 15 having a top surface 12 and a bottom surface 13. The first transaction slip 15 is substantially transparent, or translucent, so that an image imprinted on the bottom surface 13 will be visible when viewed through the top surface 12. In preferred practice, the bottom surface 13 is adapted to receive images by having applied thereto a substantially transparent coating 14 of an image receiving substance.

Formset 10 comprises further a second transaction slip 20 having an image transferring layer or coating 16 on the top surface 17 thereof. The bottom surface 18 of the slip 20 may be plain and uncoated.

A third transaction slip 25 is positioned beneath the second slip 20 and has a top surface 22 and bottom surface 24, both of which may be plain and uncoated.

Positioned between the second slip 20 and third slip 25 is a carbon paper slip 30 having a plain top surface 26 and a bottom surface 27 coated in customary manner with a carbon pigmented medium 28.

The transaction slips 15, 20, and 25 and carbon paper slip 30 are retained together by spots of suitable adhesive as shown at 32 to form a stub 34 for the formset 10. Each of the transaction slips is likewise formed with a line of severance such as perforations 36 so that the same can be readily removed from the stub 34 when required. The stub portions of each of said slips may be formed with sprocket holes 38 to aid in the manufacture and assembly of the formsets in a manner which will subsequently be described.

The top surfaces 12, 17, and 22 of the three transaction slips are similarly imprinted with an area or zone 40 (see FIG. 1) for entry of the particulars of the transaction therein by the merchant. Each top surface also includes a generally blank zone 42 adjacent the stub 34 where the customer's credit card information, such as the credit card number and usually also the name, will be imprinted. In use, the customer's identification will always be imprinted in the zone 42 which may be conveniently referred to as the credit information zone.

Figure 3:
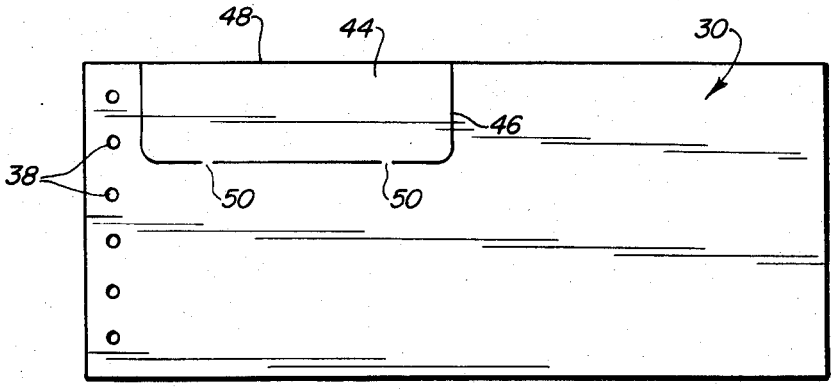
FIG. 3 is a top plan view of the carbon paper slip of the formset prior to actual use.
Figure 4:
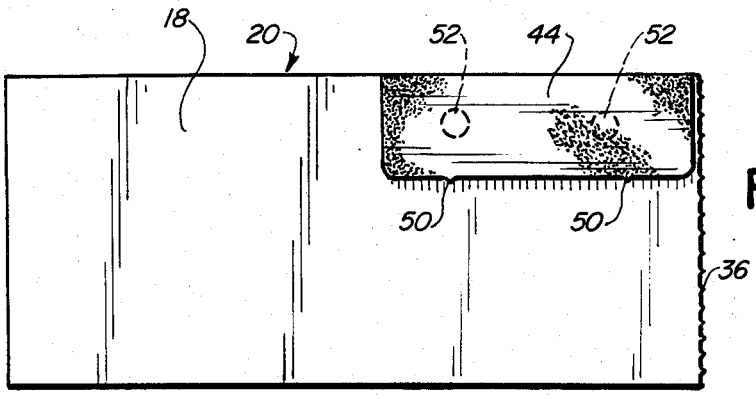
FIG. 4 is a bottom plan view of the customer's slip after use and removal from the formset.

Referring specifically to FIG. 3 of the drawings, it will be noted that the carbon paper slip 30 is formed with a zone or segment 44 defined by a line of perforation such as die cut 46. In the embodiment illustrated, the die cut is located in the upper left-hand corner and opens to the upper edge 48 of the carbon slip. The die cut 46 may also include a pair of easily rupturable ties or tabs 50. When fully assembled into the formset 10, the carbon paper slip segment 44 lies in substantial registry with the credit information zone 42 (see FIG. 1 where the segment 44 is shown in dotted line). During assembly of the formset 10, as will subsequently be described, the bottom surface 18 of the slip 20 has applied thereto one or more spots of adhesive such as at spots 52 so that the carbon paper slip zone 44 becomes adhered to the bottom of the customer's, or second, transaction slip 20. As a result, when the second slip 20 is removed from the stub 34, it carries with it the carbon paper zone 44 which has the negative image of the customer's credit information (see FIG. 4). Since this credit information zone is now given to the customer, the chances of the same falling into unauthorized hands is virtually eliminated because it is within the control of the customer, who may remove and dispose of the segment as he wishes. The carbon paper segment is relatively small and is well bonded to the associated transaction slip, and thus is much preferable to the large, floppy carbon paper sheet portion given to the customer with current credit card formsets, such as those of U.S. Pat. No. 4,403,793.

Figure 5:
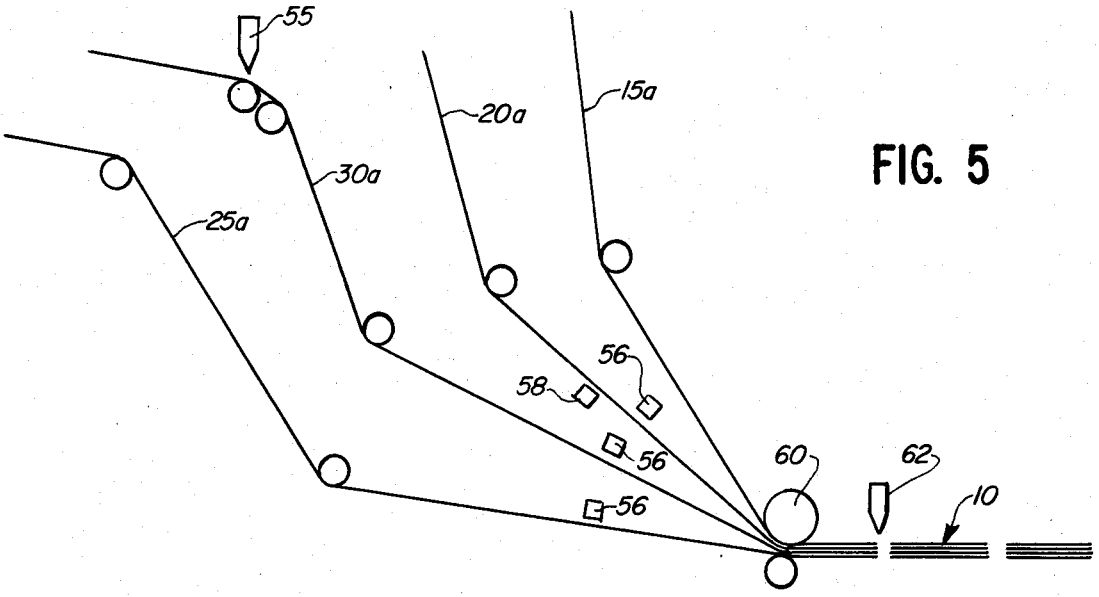
FIG. 5 is a schematic view of a method for assembling the formset of the invention.
Figure 6:
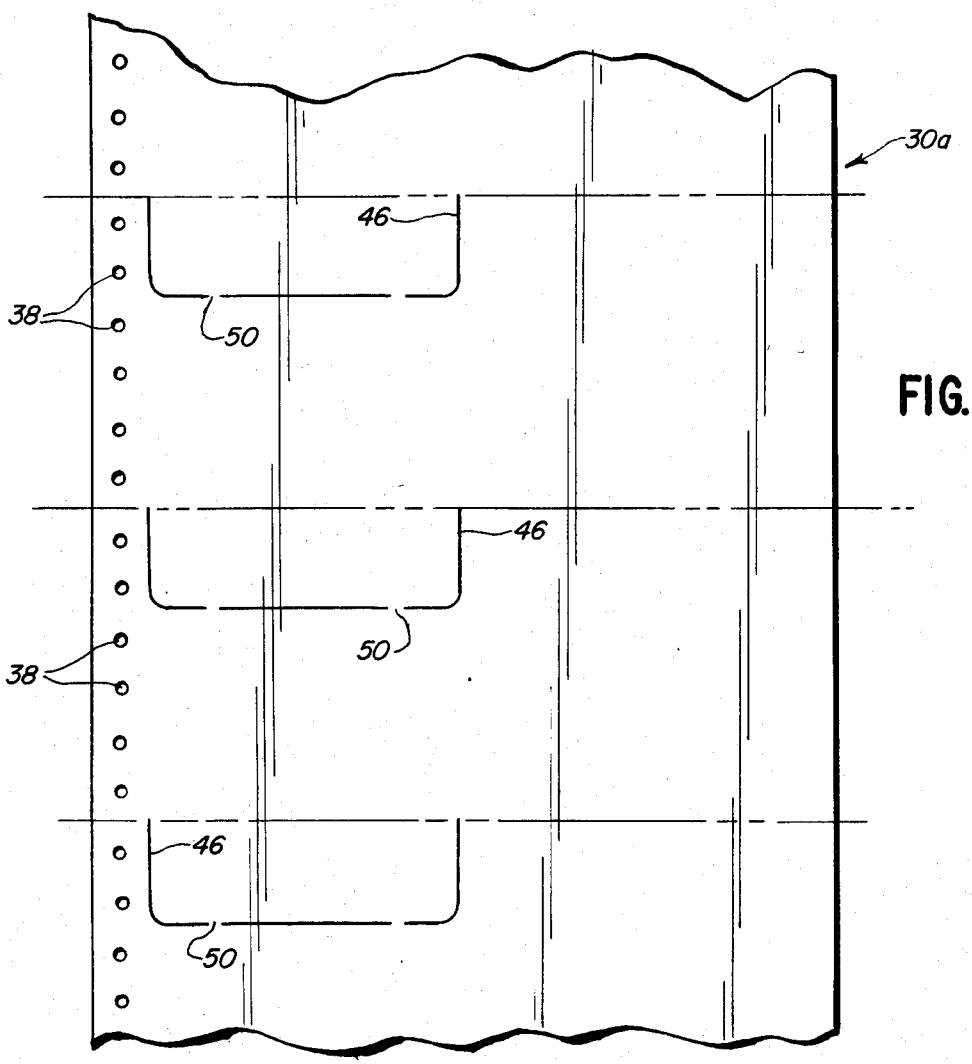
FIG. 6 is an enlarged plan view of a fragment of the continuous web of carbon paper employed in making the formsets.

Referring now to FIGS. 5 and 6, an exemplary manner of assembly of the formsets 10 can be seen. Continuous webs 15a, 20a, 25a, and 30a of the respective first, second, and third transaction slips and carbon paper slips are fed simultaneously and synchronously over associated rollers. A suitable die 55 acts on the web 30a to form the die cuts 46 which are properly spaced to provide one cut per assembled formset (see FIG. 6). The layers of adhesive 32 are applied to the top surfaces of the webs 20a, 25a, and 30a by suitably positioned applicators 56 as the webs pass thereunder. At the same time, an applicator 58 applies spots of adhesive 52 to the bottom surface 18 of the web 20a. Of course, the adhesive may be applied to the upper surface of web 30a instead of to the bottom surface of web 20a. As all four webs pass under the nip of the assembly roller 60, they are adhered together and are thereafter appropriately cut by the cutter 62 to form the formsets 10. As will be appreciated from FIG. 6, the cut 46 could be continuous and eliminate the ties 50, since the upper edge 48 of the carbon paper slip 30 is not formed until cut from the web 30a by the cutter 62, by which time the severable zone 44 has already become adhered to the slip 20.

As described in my aforementioned co-pending application, the merchant's, or first, transaction slip 15 may be prepared from a variety of substantially transparent materials. Included among these materials are substantially clear plastics such as polyethylene, polypropylene, and polyethylene terephthalate. Paper-derived webs are particularly preferred and include glassine and tracing papers as well as tissue paper and the like. Tissue paper having a weight of about 20 to about 30 pounds per ream of 24 inch by 36 inch paper is particularly preferred for use as the first slip.

The image receiving substance or coating 14 is provided on the back of the slip 15 to promote transfer of the image to, and retention of the transferred image from the image transferring layer 16 on, the image receiving surface. The image receiving coating of the slip 15 is preferably composed of a waxy substance. A suitable waxy substance is a mixture of relatively soft, low melting point microcrystalline waxes, paraffin waxes and oxidized homopolyethylene. The useful microcrystalline waxes have typical melting point ranges of about 160° F. to about 185° F. and have needle penetration values of about 20 to about 85. The paraffin waxes typically have a melting point range of about 135° F. to about 155° F., while the oxidized homopolyethylene melts in the range of about 215° F. to about 255° F. The microcrystalline waxes are typically present at about 45 to about 75 weight percent of the waxy substance, with the paraffin wax typically being present at about 20 to about 40 weight percent and the oxidized homopolyethylene being present at about 2 to about 8 weight percent. Additional materials such as plasticizers and fillers may also be present.

A particularly preferred waxy substance comprising the image receiving coating 14 typically has a congealing point in the range of about 155° F. to about 175° F., with a melting point range of about 165° F. to about 185° F. A useful, particularly preferred waxy substance is available from Frye Copysystems, Inc. of Des Moines, Iowa and is sold under the trademark IMPACT CF coating. The particularly preferred waxy substance is coated onto the slip 15 at a temperature of about 200° F. to about 235° F. using standard coating methods. Use of a coating temperature at least about 15° F. above the melting temperature of the waxy substance permits penetration of the waxy layer into the slip 15. The waxy coating is preferably applied in an amount to provide a layer 14 weighing about 0.7 to about 1.3 pounds per ream of 20 inch by 30 inch paper, where the entire surface of the paper is coated.

Coating weights of the waxy material below the preferred amounts may result in broken images upon transfer from the image transferring layer 16. Coating weights above the preferred amount can be used, but provide a substantially continuous waxy film on the slip 15 which tends to prevent penetration and drying of subsequently applied printing inks. Coating of the image receiving layer 14 in the above, preferred range, provides a layer 14 which is slightly discontinuous and permits penetration of subsequently applied printing inks into the first slip for drying purposes. Viewing of a first slip so prepared in the light usually shows hills and valleys of the coating that comprises the image receiving layer 14.

The remaining slips of the formsets 10 can be made from various papers and synthetic fibers as known in the art for the preparation of tickets and other multipart instruments. In preferred practice, the slips are paper, and the surfaces of the paper are hardened and smoothed as desired or necessary with conventional sizings and/or by calendering.

The image transferring layer 16 of the second slip 20 comprises a particulate matrix, and may be made in accordance with the teachings of U.S. application Ser. No. 425,064, filed Sept. 30, 1982, the disclosure of which is here incorporated by reference. Thus, the particulate matrix is erasably bonded to the second slip and is defaceable when rubbed with an organic solvent. Preferably, the particulate matrix is also removable when an adhesive tape is applied thereto and is then pulled away.

The particulate matrix can itself be comprised of a number of solid materials that are insoluble or substantially insoluble in water and organic solvents. Exemplary particulate materials include usual inorganic pigments and fillers such as titanium dioxide, zinc oxide, silica, calcium carbonate, calcium sulfate, and the like and mixtures thereof. The choice of fillers can be made to vary the opacity of the ultimately formed, transferred image.

The particles are ground to a fine consistancy so that they can be printed, preferably flexographically, upon the upper surface of the second slip 20. A useful average particle size is about 15 to about 16 microns for the largest dimension. Preferably, the average particle size is about 5 to about 6 using North Standard Measurements of of particle size which correspond to particles having an average largest dimension of about 25 to about 40 microns.

The particulate matrix is erasably bonded to the slip 20 by an organic polymer that can be soluble or dispersible in organic solvent or in water or mixtures thereof. Exemplary organic polymers include the preferred polyvinyl butyral resin, acrylic ester homopolymers and copolymers, such as those of acrylic acid and methacrylic acid esters of $C_1$–$C_8$ alcohols polymerized with themselves as well as with other monomers such as styrene, acrylic acid, methacrylic acid, maleic acid, acrylamide, methacrylamide and N-substituted $C_1$–$C_8$ derivatives thereof.

In preferred practice, the weight ratio of organic solvent-soluble polymer to that of the particulate matrix in the preferred flexographic-type ink is about 1:3 to about 1:5.

It is preferred that the polymer be dissolved or dispersed in an organic solvent, and the phrase "organic solvent" is used illustratively with the understanding that water, admixtures of water with an organic solvent may also be useful. The words "soluble" and "dissolved" will be used for convenience hereafter to include materials that are soluble or dispersible, and dissolved or dispersed, respectively.

As noted above, the image transferring layer 16 is preferably flexographically printed onto the second slip 20. To that end, the particulate matrix and bonding polymer are dissolved in a suitable solvent to form a flexographic-type ink. The image transferring layer 16 can be applied to the slip by lithographic, gravure, or similar printing techniques, as well as by the preferred flexographic process.

The phrase "organic solvent" is used herein to include usual liquid solvents of low molecular weight (less than about 250 Daltons). Typically useful organic solvents for the flexographic ink include hydrocarbon solvents such as hexane and benzene, ketones such as acetone and methyl ethyl ketone, and esters such as ethyl acetate and butyl acetate, chlorocarbons such as trichloroethylene, trichloroethane and chloroform, as well as alcohols such as methanol, ethanol, and the like. In addition, mixed organic solvents, such as lacquer thinner and mineral spirits as well as mixtures of the above solvents fall within the definition "organic solvent" as used herein. A particularly preferred organic solvent is ethanol.

The organic solvent is preferably used in a volume, which if anhydrous ethanol, would comprise about 40 to about 60 weight percent of the total flexographic-type ink used for making the image tranferring layers 22, 26. More preferably, the volume of organic solvent comprises about 45 to about 55 weight percent of the flexographic-type ink, as absolute ethanol.

The amounts of the above ingredients comprising the preferred flexographic-type ink used to prepare the image tranferrring layer 16 are easily adjusted to provide a coating, after drying at a 150° F., of about 1.25 to about 1.55 pounds per ream of coated paper; the paper measuring 20 inches by 30 inches. In more preferred practice, the amount of image transferring means after drying is about 1.3 to about 1.45 pounds per ream calculated upon the area the web covered with the transferring means. That desired amount is typically obtainable from a composition that has a viscosity using Zahn No. 2 conditions at 70° F. (21° C.) of about 50 to about 65 seconds.

When less than the above amounts of image transferring layer material is applied to the slip surface, transfer of an image to the image receiving surface of the upper, overlying slip can be impaired. When greater than the above amounts of image transferring material is applied as that layer, the image transferring layer tends to crack or flake off prematurely, and some of the flexibility of the image transferring layer is lost.

As noted previously, the surface of the slip 20 including the image transferring layer 16 may define zones from which the images are transferred. Those zones are defined by information indicia, or data applied at least in part over or under the image transferring layer, as by conventional printing techniques such as offset and lithographic printing, using standard printing means. Desired colors of the layer 16 may be provided by dyes in the coating or by suitable overprinting. Thus a large number of color and pattern variations may be obtained as distinguished from the single color and pattern obtainable with typical carbon papers.

The duplicating layer 28 may be made from a substance comprised of a colorant-medium dispersion, i.e., the colorant such as a dye or pigment, dispersed in a hydrophobic medium. Suitable colorants include barium lithol, carbon black, and methylviolet oleate. Exemplary hydrophobic media include carnauba wax, beeswax, paraffin waxes, and the like, or mixtures thereof. The waxes can also be used alone, as well as in combination with naturally occurring or synthetic oils, such as mineral oil, which serve to plasticize or soften them. In addition, fillers such as kaolin, petrolite, and the like may also be present in the colorant-medium dispersion. Other conventional carbon papers of the types now used in credit card transaction formsets are known and may be used.

The words "inscribed" or impressed in their various grammatical forms as used herein mean a sufficient amount of pressure is applied directly or indirectly to the surface of the first slip, such that an image corresponding to the inscribed image can be transferred from the image transferring layer 16 on second slip 20 to the surface 13 of the first slip and also downwardly to the second slip through the carbon slip 30. Normal pressures used in writing with a ballpoint pen, pencil or typewriter are sufficient for that inscribing.

Thus, the preferred formset of the present invention utilizes a carbon slip, but eliminates the potential for fraud inherent in the use of conventional credit card transaction formsets. The preferred formset, in the preferred embodiment, also eliminates one of the carbon slips, the double-sided carbon slip, and substitutes therefore a tamper-resisting customer transaction slip which cooperates with the transparent top slip in the manner described in U.S. application Ser. No. 425,064.

It should be appreciated without further description that the invention affords an almost complete solution to the previously existing problem of the carbon paper slips with the customer credit information carried thereon falling into improper hands. The security feature is automatic. Thus, each time the customer's slip is removed from the formset and handed to the customer, the credit information zone of the carbon paper slip goes to the customer and to no one else.

From the foregoing, it will be observed that numerous variations and modifications can be effected without departing from the true spirit and scope of the novel concept of the invention. It is to be understood that no limitation with respect to the specific embodiment illustrated herein is intended or should be inferred. It is, of course, intended to cover by the appended claims all such modifications as fall within the scope of the claims.

What is claimed is:

1. A credit card transaction formset, including a zone therein in which the customer's identification is adapted to be impressed via an embossed credit card and an image impressing machine, the formset including at least two transaction slips and an interleaved duplicating slip, each said slip being secured at one end to form a stub and defining an opposite free end remote from said stub, and each of said transaction slips defining a line of severance adjacent said one end for removal thereof from said stub, said duplicating slip defining a segment intermediate said ends and at the zone in which the customer's identification is adapted to be impressed, said segment being dimensioned to receive the entirety of said customer's identification, said segment being removable from said duplicating slip along a line of perforation provided in said duplicating slip, and means securing said segment to the overlying one of said transaction slips so that when said overlying transaction slip is removed from said stub along its line of severance, said segment is automatically removed therewith.

2. A credit card formset according to claim 1 wherein there are three of said transaction slips.

3. A credit card formset according to claim 2 wherein said duplicating slip is disposed between the intermediate and bottom slip of said three transaction slips.

4. A credit card formset according to claim 3 wherein the top transaction slip is generally transparent, the intermediate transaction slip is adapted to be given to the customer and the bottom transaction slip is a record keeping slip.

5. A credit card formset according to claim 4 wherein said top transaction slip has an image receiving coating on the bottom surface thereof and the confronting transaction slip has an image transferring coating on the top surface thereof.

6. A credit card formset according to claim 5 wherein said image receiving coating comprises a coating of a waxy substance.

7. A credit card formset according to claim 6 wherein said waxy substance includes a mixture of relatively soft, low melting point microcrystalline waxes, paraffin waxes, and oxidized homopolyethylene.

8. A credit card formset according to claim 5 wherein said image transferring coating comprises a particulate matrix on said intermediate transaction slip and including a colorant, said particulate matrix being erasably bonded to said intermediate transaction slip and being defaceable when rubbed with an organic solvent.

9. A credit card formset according to claim 1 wherein said segment is defined at one edge by the upper edge of said duplicating slip.

10. A credit card formset according to claim 9 wherein said means securing said segment to said one transaction slip comprises adhesive.

11. A credit card transaction formset, including a zone therein in which the customer's identification is adapted to be impressed, the formset including at least three transaction slips comprising a merchant slip, a customer slip, and credit card issuer slip, and an interleaved carbon paper slip intermediate the customer slip and another of said transaction slips, each said slip being secured at one end to form a stub and defining an opposite free end remote from said stub, and each of said transaction slips defining a line of severance adjacent said one end for removal thereof from said stub, the uppermost of said slips being generally transparent and being adapted to receive an image on the bottom surface thereof, the customer slip having an image transferring coating on its upper surface and confronting said bottom surface, said carbon paper slip defining a segment intermediate said ends and at the zone in which the customer's identification is adapted to be impressed, said segment being dimensioned to receive the entirety of said customer's identification, said segment being removable from said carbon paper slip along a line of perforation provided in said carbon paper slip, and means adhering said segment to the overlying customer transaction slip so that when said overlying customer transaction slip is removed from said stub along its line of severance, said segment is automatically removed therewith.

12. A credit card transaction formset according to claim 11, and wherein said bottom surface of the transparent slip bears an image receiving coating comprising a coating of a waxy substance.

13. A credit card transaction formset according to claim 12 wherein said image transferring coating comprises a particulate matrix including a colorant, said particulate matrix being erasably bonded to said customer transaction slip and being defaceable when rubbed with an organic solvent.

14. A credit card transaction formset according to claim 13 wherein said segment is defined at one edge by the upper edge of said carbon paper slip.

15. A credit card formset according to claim 9, further comprising a tie connecting said segment to said duplicating slip along the line of perforation.

16. A credit card formset according to claim 14 comprising a pair of ties connecting said segment to said duplicating slip along said line of perforation, said ties being readily rupturable permitting removal of said segment with said overlying transaction slip.

* * * * *